US011754266B2

(12) United States Patent
Harvey et al.

(10) Patent No.: US 11,754,266 B2
(45) Date of Patent: Sep. 12, 2023

(54) UTILITY MOUNT LIGHT

(71) Applicant: MILWAUKEE ELECTRIC TOOL CORPORATION, Brookfield, WI (US)

(72) Inventors: Kyle Harvey, West Allis, WI (US); Jason D. Thurner, Menomonee Falls, WI (US); David Proeber, Milwaukee, WI (US); Justin D. Dorman, Madison, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/987,048

(22) Filed: Nov. 15, 2022

(65) Prior Publication Data

US 2023/0072494 A1 Mar. 9, 2023

Related U.S. Application Data

(63) Continuation of application No. 17/862,844, filed on Jul. 12, 2022, now Pat. No. 11,525,562, which is a (Continued)

(51) Int. Cl.
*F21V 21/14* (2006.01)
*F21L 4/02* (2006.01)
(Continued)

(52) U.S. Cl.
CPC ..... *F21V 21/145* (2013.01); *F21L 4/027* (2013.01); *F21L 4/04* (2013.01); *F21V 21/0885* (2013.01);
(Continued)

(58) Field of Classification Search
CPC .... F21V 21/145; F21V 21/0885; F21V 21/30; F21V 21/406; F21V 23/0414; F21L 4/027; F21L 4/04
See application file for complete search history.

(56) References Cited

U.S. PATENT DOCUMENTS 3,331,958 A 7/1967 Adler
3,973,179 A 8/1976 Weber et al.
(Continued)

FOREIGN PATENT DOCUMENTS

CN 303851715 9/2016
DE 10023183 A1 11/2001
(Continued)

OTHER PUBLICATIONS

Extended European Search Report for Application No. 16198619.5 dated Mar. 1, 2017, 9 pages.
(Continued)

*Primary Examiner* — Peggy A Neils
(74) *Attorney, Agent, or Firm* — Michael Best & Friedrich LLP

(57) ABSTRACT

A utility light mountable to a workpiece including a main body having a first end, a second end opposite the first end, and a length extending between the first end and the second end. A light assembly is coupled to the main body and has a light housing and a light source disposed within the light housing. The light housing is pivotable and rotatable relative to the main body. The utility light further includes a battery support portion configured to selectively receive a battery. The battery support portion disposed at the first end of the main body. A handle assembly is coupled to the second end of the main body. The handle assembly has a first member configured to be grasped for carrying and maneuvering the utility light and a second member that is moveable relative to the first member.

20 Claims, 8 Drawing Sheets

Related U.S. Application Data continuation of application No. 17/381,791, filed on Jul. 21, 2021, now Pat. No. 11,448,383, which is a continuation of application No. 16/999,742, filed on Aug. 21, 2020, now Pat. No. 11,073,265, which is a continuation of application No. 16/404,197, filed on May 6, 2019, now Pat. No. 10,753,585, which is a continuation of application No. 15/349,689, filed on Nov. 11, 2016, now Pat. No. 10,323,831.

(60) Provisional application No. 62/255,078, filed on Nov. 13, 2015.

(51) Int. Cl.

| | |
|---|---|
| ***F21V 21/30*** | (2006.01) |
| ***F21V 23/04*** | (2006.01) |
| ***F21L 4/04*** | (2006.01) |
| ***F21V 21/088*** | (2006.01) |
| ***F21V 21/40*** | (2006.01) |

(52) U.S. Cl.

CPC ..... *F21V 21/30* (2013.01); *F21V 21/406* (2013.01); *F21V 23/0414* (2013.01)

(56) References Cited

U.S. PATENT DOCUMENTS

| | | | |
|---|---|---|---|
| 4,032,771 | A | 6/1977 | Ilzig |
| 4,228,489 | A | 10/1980 | Martin |
| 4,268,894 | A | 5/1981 | Bartunek et al. |
| 4,324,477 | A | 4/1982 | Miyazaki |
| 5,019,951 | A | 5/1991 | Osterhout et al. |
| 5,203,621 | A | 4/1993 | Weinmeister et al. |
| 5,207,747 | A | 5/1993 | Gordin et al. |
| 5,351,172 | A | 9/1994 | Attree et al. |
| 5,400,234 | A | 3/1995 | Yu |
| 5,428,520 | A | 6/1995 | Skief |
| D376,535 | S | 12/1996 | Gary et al. |
| 5,630,660 | A | 5/1997 | Chen |
| D392,065 | S | 3/1998 | Morrow et al. |
| 5,934,628 | A | 8/1999 | Bosnakovic |
| 5,944,407 | A | 8/1999 | Lynch et al. |
| 5,964,524 | A | 10/1999 | Qian |
| D422,203 | S | 4/2000 | Gary et al. |
| 6,045,240 | A | 4/2000 | Hochstein |
| D424,418 | S | 5/2000 | Gary et al. |
| D428,176 | S | 7/2000 | Bamber et al. |
| 6,092,911 | A | 7/2000 | Baker, III et al. |
| 6,099,142 | A | 8/2000 | Liu |
| 6,149,283 | A | 11/2000 | Conway et al. |
| 6,183,114 | B1 | 2/2001 | Cook et al. |
| D438,998 | S | 3/2001 | Finke et al. |
| 6,213,626 | B1 | 4/2001 | Qian |
| 6,255,786 | B1 | 7/2001 | Yen |
| 6,265,969 | B1 | 7/2001 | Shih |
| D452,022 | S | 12/2001 | Osiecki et al. |
| 6,367,949 | B1 | 4/2002 | Pederson |
| 6,379,023 | B1 | 4/2002 | Passno |
| 6,394,631 | B1 | 5/2002 | Yuen |
| 6,461,017 | B2 | 10/2002 | Selkee |
| 6,474,844 | B1 | 11/2002 | Ching |
| 6,554,459 | B2 | 4/2003 | Fu et al. |
| 6,637,904 | B2 | 10/2003 | Hernandez |
| D494,849 | S | 8/2004 | Jones et al. |
| 6,802,623 | B1 | 10/2004 | Hsu et al. |
| 6,824,297 | B1 | 11/2004 | Lee |
| 6,854,862 | B1 | 2/2005 | Hopf |
| 6,857,756 | B2 | 2/2005 | Reiff et al. |
| 6,873,249 | B2 | 3/2005 | Chu |
| 6,877,881 | B2 | 4/2005 | Tsao |
| 6,899,441 | B2 | 5/2005 | Chen |
| D506,847 | S | 6/2005 | Hussaini et al. |
| 6,902,294 | B2 | 6/2005 | Wright |
| 6,926,428 | B1 | 8/2005 | Lee |
| 6,953,260 | B1 | 10/2005 | Allen |
| 7,001,044 | B2 | 2/2006 | Leen |
| 7,001,047 | B2 | 2/2006 | Holder et al. |
| 7,011,280 | B2 | 3/2006 | Murray et al. |
| 7,063,444 | B2 | 6/2006 | Lee et al. |
| 7,073,926 | B1 | 7/2006 | Kremers et al. |
| D529,360 | S | 10/2006 | Wimmer |
| D529,926 | S | 10/2006 | Krieger et al. |
| D532,536 | S | 11/2006 | Krieger et al. |
| 7,152,997 | B1 | 12/2006 | Kovacik et al. |
| 7,153,004 | B2 | 12/2006 | Galli |
| D537,330 | S | 2/2007 | Cox et al. |
| D538,636 | S | 3/2007 | Jackson et al. |
| 7,194,358 | B2 | 3/2007 | Callaghan et al. |
| 7,195,377 | B2 | 3/2007 | Tsai |
| 7,224,271 | B2 | 5/2007 | Wang |
| D549,859 | S | 8/2007 | Kovacik et al. |
| D551,048 | S | 9/2007 | Huang |
| D551,532 | S | 9/2007 | Huang |
| D553,281 | S | 10/2007 | Rugendyke et al. |
| D553,461 | S | 10/2007 | Neiser |
| D553,771 | S | 10/2007 | Watson et al. |
| D553,783 | S | 10/2007 | Loftus et al. |
| 7,278,761 | B2 | 10/2007 | Kuan |
| D556,353 | S | 11/2007 | Gebhard et al. |
| 7,350,940 | B2 | 4/2008 | Haugaared et al. |
| 7,364,320 | B2 | 4/2008 | Van Deursen et al. |
| 7,367,695 | B2 | 5/2008 | Shiau |
| 7,470,036 | B2 | 12/2008 | Deighton et al. |
| 7,484,858 | B2 | 2/2009 | Deighton |
| 7,503,530 | B1 | 3/2009 | Brown |
| D593,236 | S | 5/2009 | Ng et al. |
| D595,105 | S | 6/2009 | White |
| 7,566,151 | B2 | 7/2009 | Whelan et al. |
| 7,618,154 | B2 | 11/2009 | Rosiello |
| 7,638,970 | B1 | 12/2009 | Gebhard et al. |
| 7,670,034 | B2 | 3/2010 | Zhang et al. |
| 7,798,684 | B2 | 9/2010 | Boissevain |
| 7,828,465 | B2 | 11/2010 | Roberge et al. |
| 7,857,486 | B2 | 12/2010 | Long et al. |
| 7,914,178 | B2 | 3/2011 | Xiang et al. |
| 7,914,182 | B2 | 3/2011 | Mrakovich et al. |
| 7,972,036 | B1 | 7/2011 | Schach et al. |
| D643,138 | S | 8/2011 | Kawase et al. |
| 7,988,335 | B2 | 8/2011 | Liu et al. |
| 7,990,062 | B2 | 8/2011 | Liu |
| 7,997,753 | B2 | 8/2011 | Walesa |
| 8,007,128 | B2 | 8/2011 | Wu et al. |
| 8,007,145 | B2 | 8/2011 | Leen |
| 8,029,169 | B2 | 10/2011 | Liu |
| 8,047,481 | B2 | 11/2011 | Shen |
| 8,087,797 | B2 | 1/2012 | Pelletier et al. |
| 8,142,045 | B2 | 3/2012 | Peak |
| 8,167,466 | B2 | 5/2012 | Liu |
| 8,201,979 | B2 | 6/2012 | Deighton et al. |
| D665,521 | S | 8/2012 | Werner et al. |
| 8,235,552 | B1 | 8/2012 | Tsuge |
| 8,262,246 | B2 | 9/2012 | Pelletier et al. |
| 8,262,248 | B2 | 9/2012 | Wessel |
| 8,294,340 | B2 | 10/2012 | Yu et al. |
| 8,322,892 | B2 | 12/2012 | Scordino et al. |
| 8,328,398 | B2 | 12/2012 | Van Deursen |
| 8,330,337 | B2 | 12/2012 | Yu et al. |
| 8,360,607 | B2 | 1/2013 | Bretschneider et al. |
| 8,366,290 | B2 | 2/2013 | Maglica |
| 8,403,522 | B2 | 3/2013 | Chang |
| D679,845 | S | 4/2013 | Huang |
| 8,425,091 | B2 | 4/2013 | Chen |
| 8,434,915 | B2 | 5/2013 | Liu et al. |
| 8,439,531 | B2 | 5/2013 | Trott et al. |
| 8,465,178 | B2 | 6/2013 | Wilcox et al. |
| 8,485,691 | B2 | 7/2013 | Hamel et al. |
| 8,547,022 | B2 | 10/2013 | Summerford et al. |
| D695,434 | S | 12/2013 | Shen |
| 8,599,097 | B2 | 12/2013 | Intravatola |
| D698,471 | S | 1/2014 | Poon |
| D699,874 | S | 2/2014 | Chilton et al. |
| 8,651,438 | B2 | 2/2014 | Deighton et al. |
| 8,659,433 | B2 | 2/2014 | Petrou |

(56) References Cited

U.S. PATENT DOCUMENTS 8,668,349 B2 3/2014 Richardson
D702,863 S 4/2014 Kotsis
D703,354 S 4/2014 Kotsis
D703,355 S 4/2014 Kotsis
D703,851 S 4/2014 Gebhard et al.
8,692,444 B2 4/2014 Patel et al.
8,696,177 B1 4/2014 Frost
D705,467 S 5/2014 Aglassinger
8,757,815 B2 6/2014 Saruwatari et al.
D708,376 S 7/2014 Crowe et al.
8,801,226 B2 8/2014 Moore
8,840,264 B2 9/2014 Molina et al.
8,851,699 B2 10/2014 McMillan
8,858,016 B2 10/2014 Strelchuk
8,858,026 B2 10/2014 Lee et al.
8,939,602 B2 1/2015 Wessel
8,979,331 B2 3/2015 Lee et al.
D726,354 S 4/2015 Davies
9,010,279 B1 4/2015 Saber et al.
D728,402 S 5/2015 Case
9,046,231 B2 6/2015 Christ et al.
9,052,072 B2 6/2015 Renk, Jr.
9,068,736 B2 6/2015 Lee et al.
D734,886 S 7/2015 Lazalier et al.
D737,487 S 8/2015 Beckett et al.
D744,139 S 11/2015 Itoh et al.
9,188,320 B2 11/2015 Russello et al.
9,205,774 B2 12/2015 Kennemer et al.
D747,263 S 1/2016 Lafferty
D750,822 S 3/2016 Hernandez et al.
D755,034 S 5/2016 DeBaker et al.
D759,291 S 6/2016 Chen
D764,700 S 8/2016 Chen
D772,670 S 11/2016 Barezzani et al.
D774,231 S 12/2016 Recker et al.
D774,674 S 12/2016 Hanwell
D776,320 S 1/2017 Bobel
9,539,952 B2 1/2017 Gebhard et al.
D779,694 S 2/2017 Crowe et al.
9,579,735 B2 2/2017 Wattenbach et al.
D781,480 S 3/2017 Zhan
D781,718 S 3/2017 Ko
9,596,776 B2 3/2017 Takahashi et al.
D784,589 S 4/2017 Chen
D788,180 S 5/2017 Mantes et al.
D788,967 S 6/2017 Chen
D799,104 S 10/2017 Chen
D804,074 S 11/2017 Fang
D805,365 S 12/2017 Ballard et al.
D816,252 S 4/2018 Harvey et al.
D820,506 S 6/2018 Chen
D823,088 S 7/2018 Laavour et al.
D824,246 S 7/2018 Ming
10,323,831 B2 6/2019 Harvey et al.
D853,623 S 7/2019 Paredes
D854,230 S 7/2019 Paredes et al.
10,571,102 B1 2/2020 Bao
D877,948 S 3/2020 Thompson
D881,431 S 4/2020 Burczyk et al.
D892,380 S 8/2020 Yan
10,948,166 B2 3/2021 Ohara et al.
2002/0136005 A1 9/2002 Lee
2002/0167814 A1 11/2002 Ching
2003/0090904 A1 5/2003 Ching
2003/0137847 A1 7/2003 Cooper
2003/0174503 A1 9/2003 Yueh
2004/0228117 A1 11/2004 Witzel et al.
2005/0201085 A1 9/2005 Aikawa et al.
2006/0007682 A1 1/2006 Reiff, Jr. et al.
2006/0028812 A1* 2/2006 Yuen ..... F21V 21/406
362/183
2006/0067077 A1 3/2006 Kumthampinij et al.
2006/0146550 A1 7/2006 Simpson et al.
2006/0279948 A1 12/2006 Tsai
2006/0285323 A1 12/2006 Fowler
2007/0211470 A1 9/2007 Huang
2007/0297167 A1 12/2007 Greenhoe
2008/0112170 A1 5/2008 Trott et al.
2008/0158887 A1 7/2008 Zhu et al.
2008/0165537 A1 7/2008 Shiau
2008/0198588 A1 8/2008 O'Hern
2008/0253125 A1 10/2008 Kang et al.
2008/0302933 A1 12/2008 Cardellini
2009/0080205 A1 3/2009 Chang et al.
2009/0097263 A1 4/2009 Ko et al.
2009/0116230 A1 5/2009 Young
2009/0134191 A1 5/2009 Phillips
2009/0135594 A1 5/2009 Yu et al.
2009/0284963 A1 11/2009 Intravatola
2009/0303717 A1 12/2009 Long
2010/0027260 A1 2/2010 Liu
2010/0027269 A1 2/2010 Lo et al.
2010/0072897 A1 3/2010 Zheng
2010/0080005 A1 4/2010 Gattar
2010/0091495 A1 4/2010 Patrick
2010/0132203 A1 6/2010 Green et al.
2010/0142213 A1 6/2010 Bigge et al.
2010/0315824 A1 12/2010 Chen
2010/0328951 A1 12/2010 Boissevain
2011/0031887 A1 2/2011 Stoll et al.
2011/0038144 A1 2/2011 Chang
2011/0050070 A1 3/2011 Pickard
2011/0058367 A1 3/2011 Shiau et al.
2011/0075404 A1 3/2011 Allen et al.
2011/0121727 A1 5/2011 Sharrah et al.
2011/0228524 A1 9/2011 Greer
2011/0286216 A1 11/2011 Araman
2011/0317420 A1 12/2011 Jeon et al.
2012/0026729 A1 2/2012 Sanchez et al.
2012/0033400 A1 2/2012 Remus et al.
2012/0033429 A1 2/2012 Van De Ven
2012/0044707 A1 2/2012 Breidenassel
2012/0048511 A1 3/2012 Moshtag
2012/0049717 A1 3/2012 Lu
2012/0057351 A1 3/2012 Wilcox et al.
2012/0087118 A1 4/2012 Bailey et al.
2012/0087125 A1 4/2012 Liu
2012/0098437 A1 4/2012 Smed
2012/0120674 A1 5/2012 Jonker
2012/0140455 A1 6/2012 Chang et al.
2012/0155104 A1 6/2012 Jonker
2012/0212963 A1 8/2012 Jigamain
2012/0234519 A1 9/2012 Lee
2012/0236551 A1 9/2012 Sharrah et al.
2012/0247735 A1 10/2012 Ito et al.
2012/0262917 A1 10/2012 Courcelle
2012/0300487 A1 11/2012 Jonker
2013/0032323 A1 2/2013 Hsu
2013/0058078 A1 3/2013 Meng
2013/0077296 A1 3/2013 Goeckel et al.
2013/0128565 A1 5/2013 Cugini et al.
2013/0148366 A1 6/2013 Adams, IV et al.
2013/0176713 A1 7/2013 Deighton et al.
2013/0187785 A1 7/2013 McIntosh et al.
2013/0258645 A1 10/2013 Weber et al.
2013/0265780 A1 10/2013 Choski et al.
2013/0322073 A1 12/2013 Hamm et al.
2014/0126192 A1 5/2014 Ancona et al.
2014/0140050 A1 5/2014 Wong et al.
2014/0192543 A1 7/2014 Deighton et al.
2014/0218936 A1 8/2014 Mahling et al.
2014/0231486 A1 8/2014 Burch et al.
2014/0268775 A1 9/2014 Kennemer et al.
2014/0301066 A1 10/2014 Inskeep
2014/0307443 A1 10/2014 Clifford et al.
2014/0376216 A1 12/2014 McLoughlin et al.
2015/0023771 A1 1/2015 Carr et al.
2015/0198298 A1 7/2015 Scarlata et al.
2015/0233569 A1 8/2015 Xue et al.
2015/0233571 A1 8/2015 Inan et al.
2016/0341239 A1 11/2016 Inkavesvaanit
2016/0354664 A1 12/2016 DeCarlo
2016/0356439 A1 12/2016 Inskeep
2017/0138575 A1 5/2017 Harvey et al.

(56) References Cited

U.S. PATENT DOCUMENTS

| | | | |
|---|---|---|---|
| 2017/0204864 | A1 | 7/2017 | Mantes et al. |
| 2017/0331163 | A1 | 11/2017 | Ebner et al. |
| 2019/0257505 | A1 | 8/2019 | Harvey et al. |
| 2019/0285257 | A1 | 9/2019 | Gall et al. |
| 2020/0378586 | A1 | 12/2020 | Harvey et al. |

FOREIGN PATENT DOCUMENTS

| | | | | | |
|---|---|---|---|---|---|
| EP | 0193756 | A2 | | 9/1986 | |
| EP | 1205428 | A1 | | 5/2002 | |
| EP | 2436641 | A1 | | 4/2012 | |
| GB | 2424694 | A | | 10/2006 | |
| GB | 2468740 | A | | 9/2010 | |
| KR | 20100116933 | A | | 11/2010 | |
| WO | 2002044503 | A1 | | 6/2002 | |
| WO | WO 2010/008855 | | * | 1/2010 | ..... F21L 4/00 |
| WO | 2014083117 | A1 | | 6/2014 | |
| WO | 2014207595 | A1 | | 12/2014 | |

OTHER PUBLICATIONS

European Patent Office Action for Application No. 16198619.5 dated May 18, 2018, 5 pages.

Milwaukee Tool, "M18 Utility Bucket Light (Tool Only)", <https:www.milwaukeetool.com/Products/Lighting/Specialty-Lights/2122-22HD>, website accessed Dec. 30, 2019, 5 pages.

Klein Tools, "Cordless Utility Bucket Light," available at <https://www.homedepot.com/p/Klein-Tools-Cordless-Utility- Bucket-LED-Light-Kit-BAT20UBL1/318822804> web page visited Jun. 8, 2023 (3 pages).

Emaner, "Emaner Dusk-to-Dawn Security Lights with Motion Sensor, 5000K Daylight White, IP65 Waterproof Outdoor, 110V 120V Dual-Head Rotatable LED Flood Light for Porch, Garage, Yard, Driveway," <https://a.co/d/iU1PwFL> web page visited May 19, 2023 (7 pages).

* cited by examiner

UTILITY MOUNT LIGHT

CROSS-REFERENCE TO RELATED APPLICATIONS

This application is a continuation of U.S. patent application Ser. No. 17/862,844, filed on Jul. 12, 2022, now U.S. Pat. No. 11,525,562, which is a continuation of U.S. patent application Ser. No. 17/381,791, filed on Jul. 21, 2021, now U.S. Pat. No. 11,448,383, which is a continuation of U.S. patent application Ser. No. 16/999,742, filed on Aug. 21, 2020, now U.S. Pat. No. 11,073,265, which is a continuation of U.S. patent application Ser. No. 16/404,197, filed on May 6, 2019, now U.S. Pat. No. 10,753,585, which is a continuation of U.S. patent application Ser. No. 15/349,689, filed on Nov. 11, 2016, now U.S. Pat. No. 10,323,831, which claims priority to U.S. Provisional Patent Application No. 62/255,078, filed on Nov. 13, 2015, the entire contents of all of which are incorporated herein by reference.

FIELD OF THE INVENTION

The present invention relates to utility lights.

SUMMARY OF THE INVENTION

The present invention provides, in one aspect, a utility light comprising a main body and a light assembly defined on the main body including a light source disposed within a light housing. The light housing is pivotable and rotatable relative to the main body. The utility light also comprises a handle movably coupled to the main body. The handle is linearly extensible relative to the main body to a position in which an opening is defined between the handle and the main body, such that the opening is configured to receive a workpiece to support the utility light. The handle has a gripping portion defined by an aperture extending through the handle.

The present invention provides, in another aspect, a utility light comprising a main body and a light assembly defined on the main body including a light source disposed within a light housing. The light housing is pivotable and rotatable relative to the main body. The utility light also comprises a handle including a portion that is movably coupled to the main body. The handle is linearly extensible relative to the main body and biased toward the main body such that the handle is configured to clamp a workpiece between the handle and the main body.

The present invention provides, in yet another aspect, a utility light comprising a main body and a handle movably coupled to the main body. The handle linearly extensible in a first direction relative to the main body and biased toward the main body in a second direction that is opposite the first direction. The utility light also comprises a light assembly defined on the main body including a light source disposed within a light housing, the light housing being pivotally supported within a yoke that is rotatable relative to the main body.

Other features and aspects of the invention will become apparent by consideration of the following detailed description and accompanying drawings.

Figure 1:
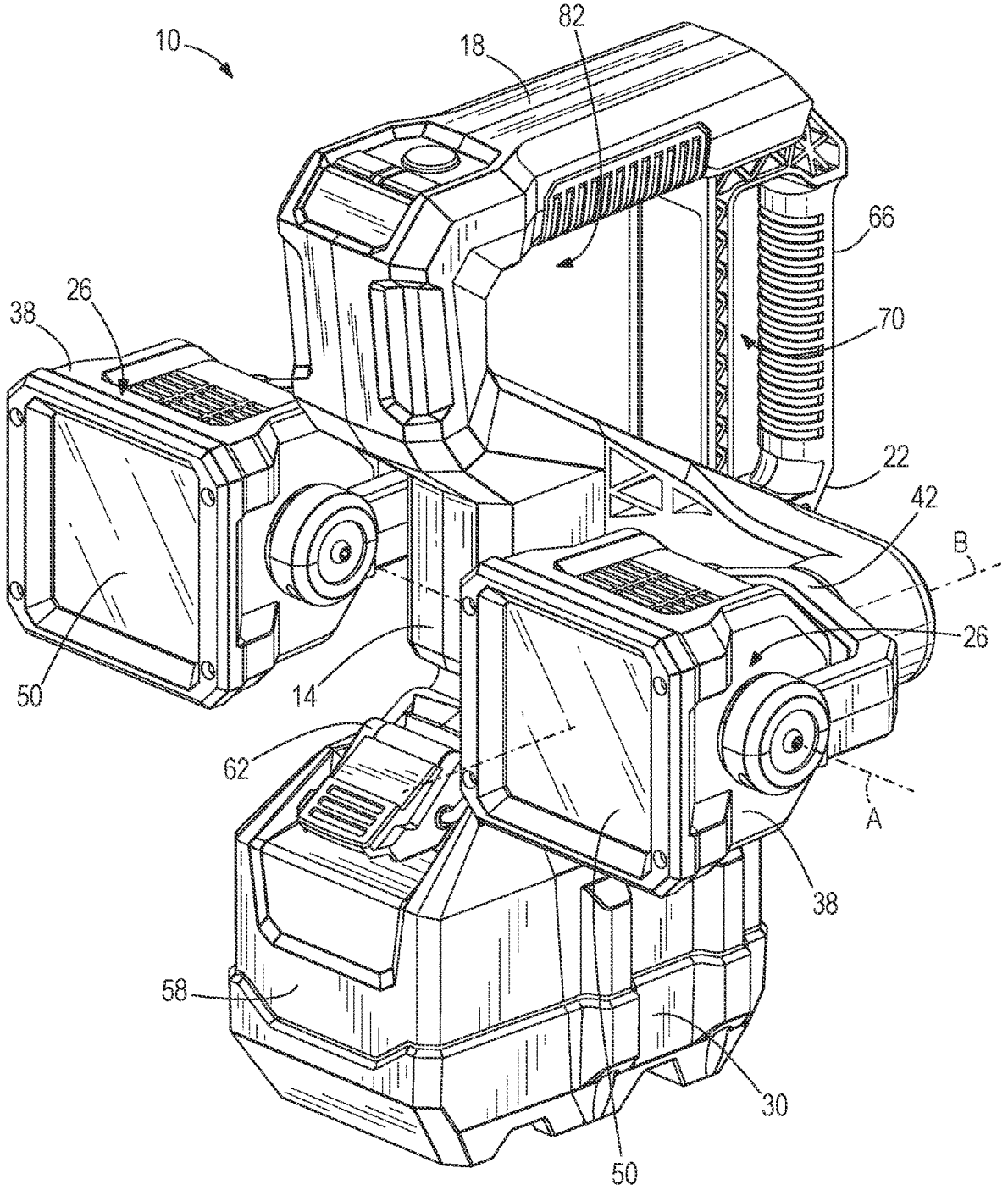
FIG. 1 is a front perspective view of a utility mount light.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-5 illustrate a utility mount light 10 including a main housing 14, a handle portion 18 supporting a handle 22, a pair of rotatable light head assemblies 26, and a battery support portion 30 configured to detachably couple a battery pack (not shown). As explained in greater detail below, the utility mount light 10 is configured to be attached to a bucket of an elevated work platform (i.e., boom lift, man lift, basket crane, hydraladder, cherry picker, etc.), other components such as tables, or to a workpiece using the handle 22. For convenience, the component to which the light 10 attaches will hereinafter be referred to as a workpiece. Once the light 10 is mounted to the workpiece, the rotatable light head assemblies 26 may be rotated as desired to illuminate a work area.

Figure 2:
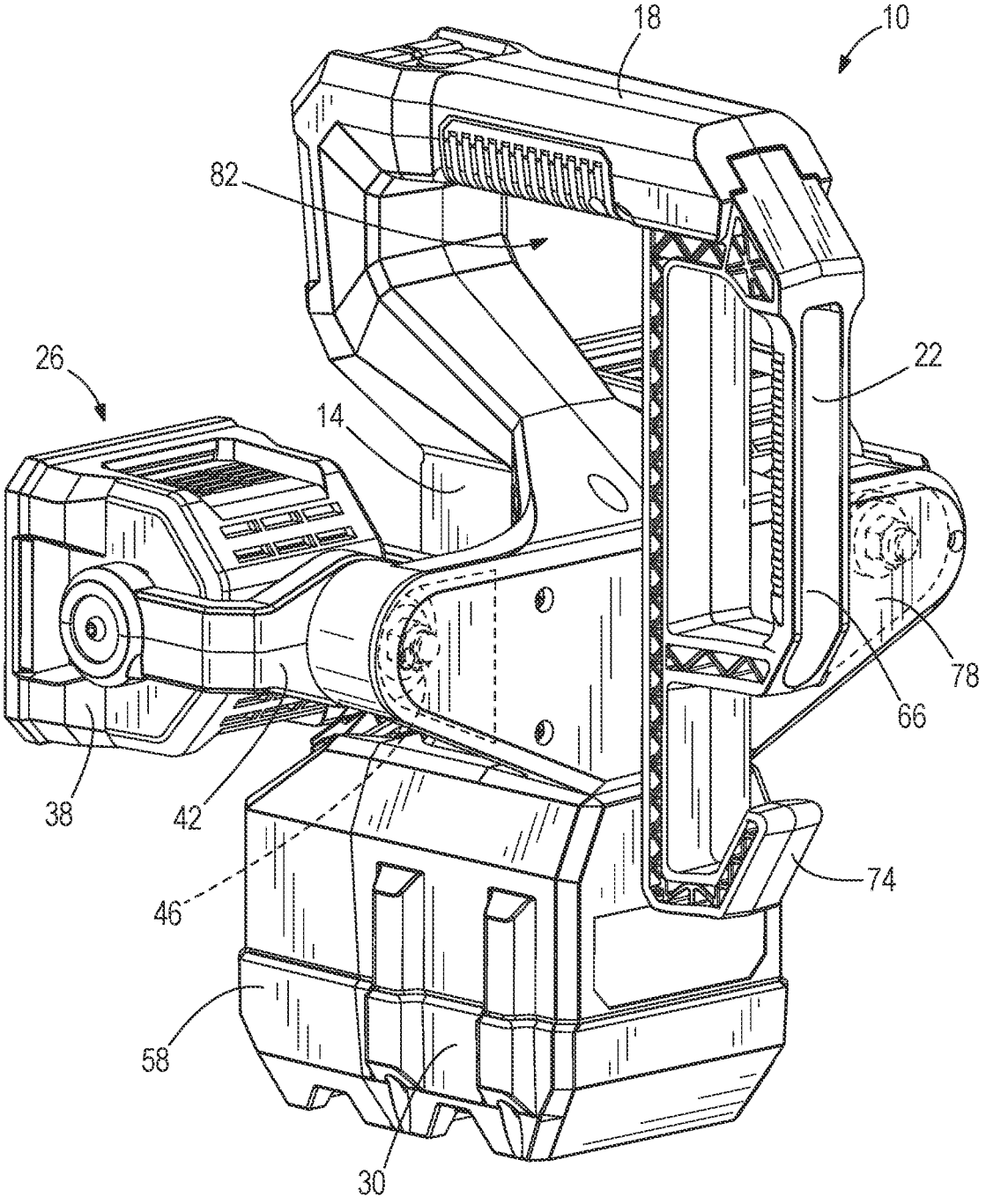
FIG. 2 is a rear perspective view of the utility mount light.

With reference to FIGS. 1 and 2, the light assemblies 26 each include a light housing 38 that is pivotally coupled between two opposed arms of a yoke 42 for pivoting motion about a first pivot axis A such that a direction of the light housing 38 is adjustable by a user. Each of the light housings 38 is independently rotatable to enhance the ability to direct the light as desired. In one embodiment, a pivoting range of the light housing 38 within the yoke 42 may be limited to approximately 180° about the first pivot axis A (e.g., via stops within the yoke 42). In another embodiment, the light housing 38 may pivot 360° about the first pivot axis A within the yoke 42. In other embodiments, the light housing 38 may have a discrete pivot range about the first pivot axis A within the yoke 42 (e.g., any discrete pivot range between 0-360°.

The yoke 42 is further coupled to the main housing 14 via a joint 46 that may be rotatable about a second pivot axis B that is orthogonal to the first pivot axis A such that a rotational orientation of the yoke 42 is adjustable by a user. In some embodiments, the yoke 42 is coupled to the main housing via a joint 46 that is rotatable 360° about the second pivot axis B. In other embodiments, the yoke 42 is coupled to the main housing 14 via a joint 46 that limits rotation (e.g., using stops in the joint 46). For example, rotation may be limited to discrete angles less than 360° but more than 180°, or rotation may be limited to discrete angles less than or equal to 180°. These configurations allow the light assemblies 26 to be directed in a variety of directions and orientations, and also allow the light assemblies 26 to be movable independently of one another.

In one embodiment, the light housing 38 may be fixed within the yoke 42 (i.e., the light housing is not pivotable) while the yoke 42 is rotatably coupled to the main housing 14 via a joint 46 that permits rotation as described above. In another embodiment, the yoke 42 may be fixedly coupled to the main housing 14 (i.e., the yoke 42 is not rotatable) while the light housing 38 is pivotable within the yoke 42 as described above. In yet another embodiment, the light housing 38 may be fixed within the yoke 42 (i.e., the light housing is not pivotable) and the yoke 42 may be fixedly coupled to the main housing 14 (i.e., the yoke 42 is not rotatable).

Figure 3:
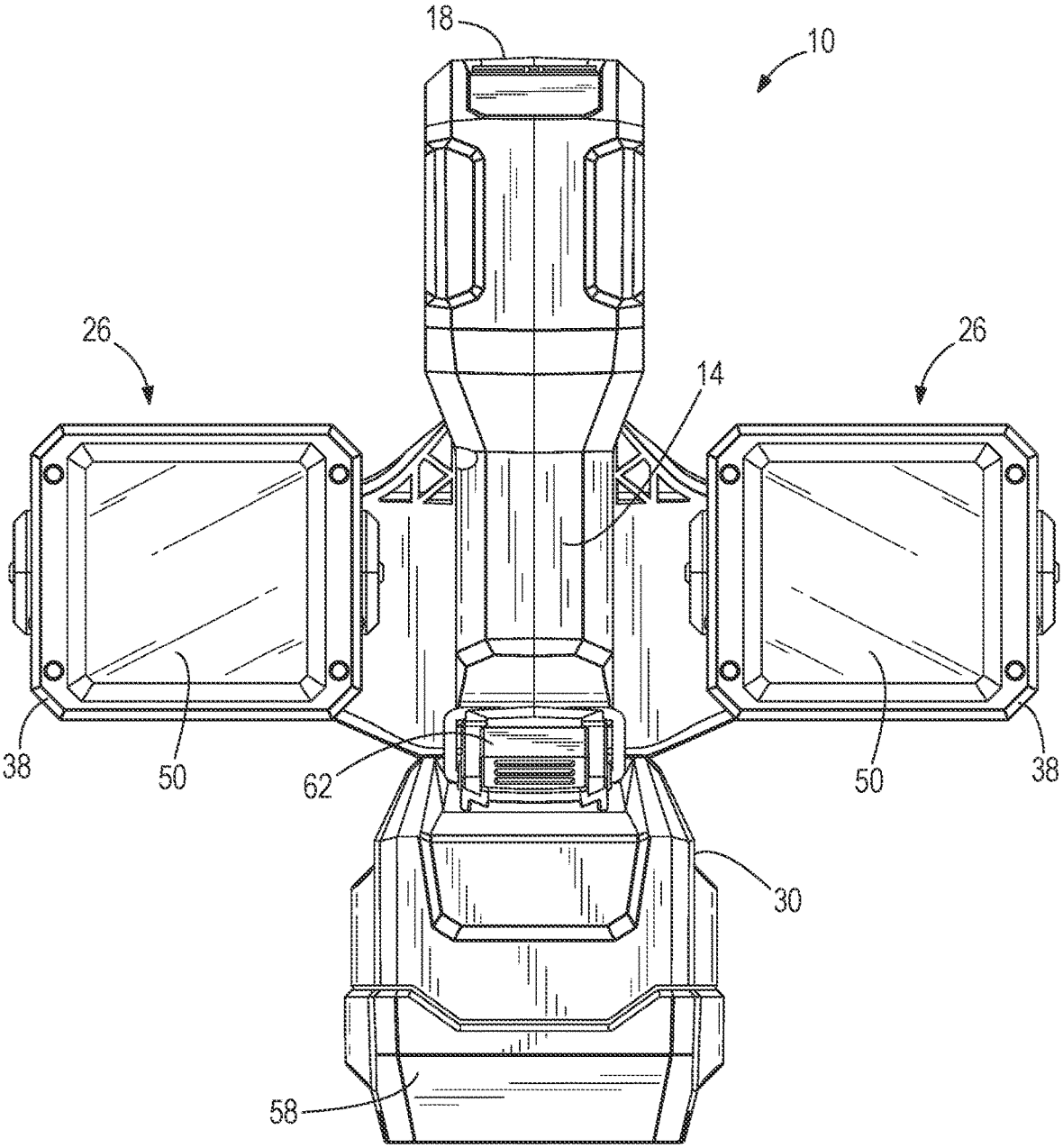
FIG. 3 is a front view of the utility mount light.

As seen in FIG. 3, the light assemblies 26 are disposed on opposing sides of the main housing 14 and the battery support portion 30.

The light housings 38 further support a plurality of lights. The lights may be, for example, spot LEDs, flood LEDs, a fluorescent bulb, an incandescent bulb, or any other suitable lighting elements. In a preferred embodiment, the lights supported within the light housing 30 are a combination of multiple spot LEDs and/or multiple flood LEDs configured to be operated separately and/or in tandem. The lights may be surrounded by a light guide disposed within the housing that directs light through lenses 50 of the light assemblies 26.

Figure 6:
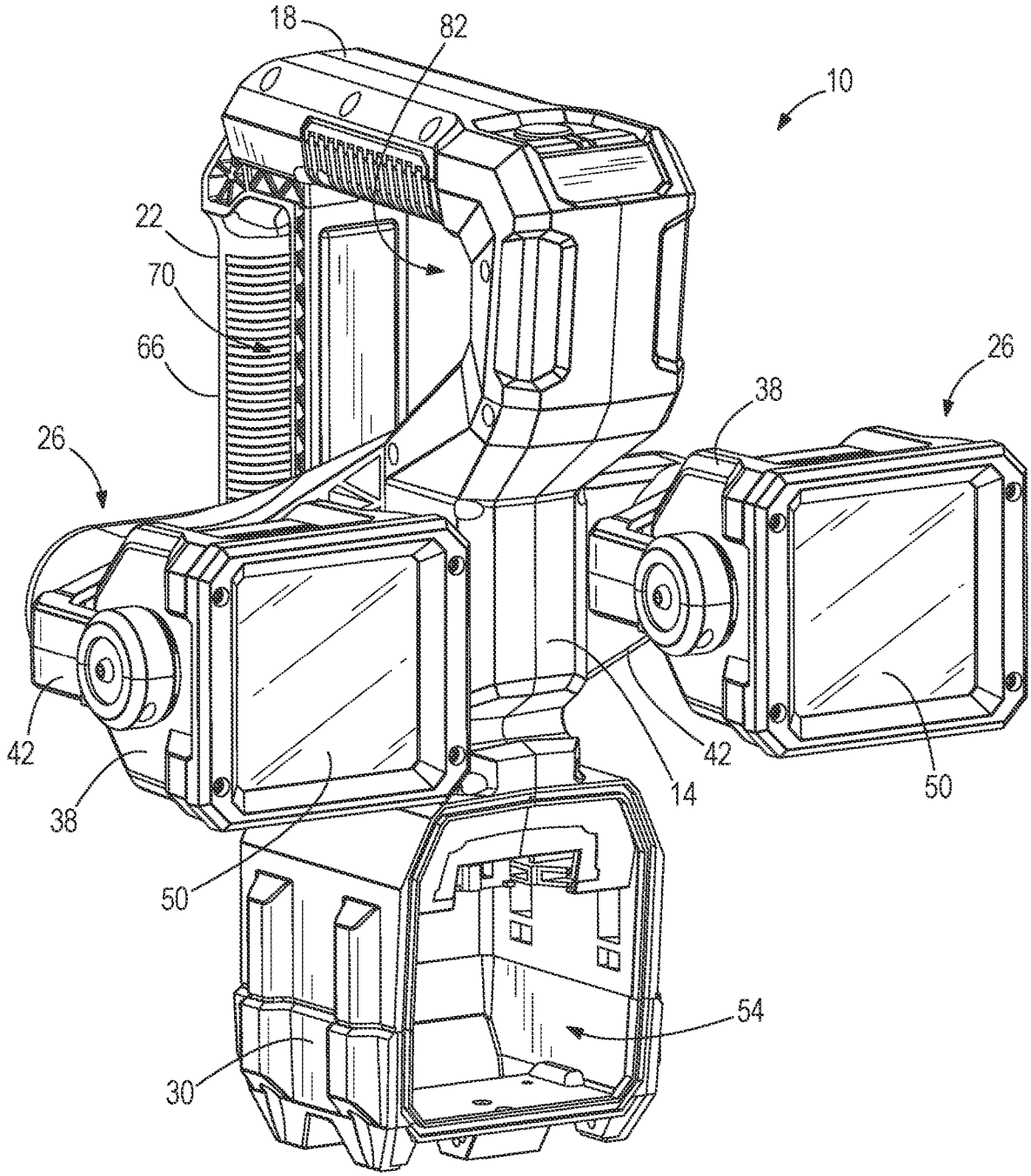
FIG. 6 is a second front perspective view with a door of a battery support portion of the utility mount light removed.

With reference to FIGS. 1 and 6, the battery support portion 30 is formed as one piece with the main housing 14 and is configured to detachably couple the battery pack. In the illustrated embodiment, the battery support portion 30 defines a cavity 54 for receiving the battery pack (FIG. 6). A door 58 is pivotally coupled to the battery support portion 30 at an open end of the cavity, and is releasably secured to the casing via a latch 62. The door 58 is further configured to sealingly engage the open end of the cavity such that, when the battery pack is secured within the cavity 54, no water or contaminants may enter the cavity 54. The sealed engagement may be accomplished by, for example, providing a gasket, an O-ring, a deformable member, or other sealing member to one or both of the battery support portion 30 and the door 58. In preferred constructions, the battery pack is a power tool battery pack.

With reference to FIG. 1, the handle portion 18 includes a power actuator, a first mode actuator, and a second mode actuator (e.g., buttons, trigger switches, knobs, etc.). Each of the actuators may be coupled to a processor supported within the utility mount light 10. The processor is coupled to the lights within each of the light housings 38 and to the battery pack control to the power supplied by the battery pack to each of the light assemblies. In some constructions, some or all of the actuators may be virtual controls (e.g., touch screens) rather than real buttons, switches, or knobs.

The processor is implemented as a microprocessor including a non-transitory, computer-readable memory that stores executable instructions to carry out functionalities of the utility mount light 10. The processor 12 may be implemented partially or entirely as, for example, a field-programmable gate array (FPGA), and application specific integrated circuit (ASIC).

The power actuator may be operated by a user to simultaneously turn both light assemblies 26 on or off. The first mode actuator may be successively operated by a user to cycle one of the light assemblies 26 through a plurality of modes, and the second mode actuator may be successively operated by a user to cycle the other light assembly 26 through the plurality of modes. The plurality of modes may include, for example, a spot mode in which spot LEDs are activated, a flood mode in which flood LEDs are activated, spot/flood mode in which both spot LEDs and flood LEDs are activated, and an off mode (i.e., such that each light assembly 26 may be independently turned off). In one embodiment, the plurality of modes may further include brightness modes for one or more of the spot mode, the flood mode, and the spot/flood mode. In another embodiment, the plurality of modes may be a multiple discrete brightness modes (e.g., low/medium/high, etc.).

In another embodiment, the utility mount light 10 may include separate power actuators for each light, such that there is a first power actuator, a second power actuator, a first mode switch, and a second mode switch. In such an embodiment, the first power actuator controls the on/off state of one of the light assemblies 26, while the second power actuator controls the on/off state of the other light assembly 26.

In yet another embodiment, the utility mount light may include a first actuator and a second actuator. In this embodiment, the first actuator is configured to operate one of the light assemblies 26 while the second actuator is configured to operate the other light assembly. The first actuator may be successively operated by a user to turn the light assembly 26 on, cycle the light assembly 26 through a plurality of modes, and turn the light assembly 26 off. The second actuator may be successively operated by a user to turn the other light assembly 26 on, cycle the other light assembly 26 through a plurality of modes, and turn the other light assembly 26 off.

In any of the embodiments described above, it should be clear that each light assembly 26 may be individually operated (i.e., turned on/off) and/or individually cycled through the plurality of modes such that the light assemblies 26 may be in independent operating states.

Figure 4:
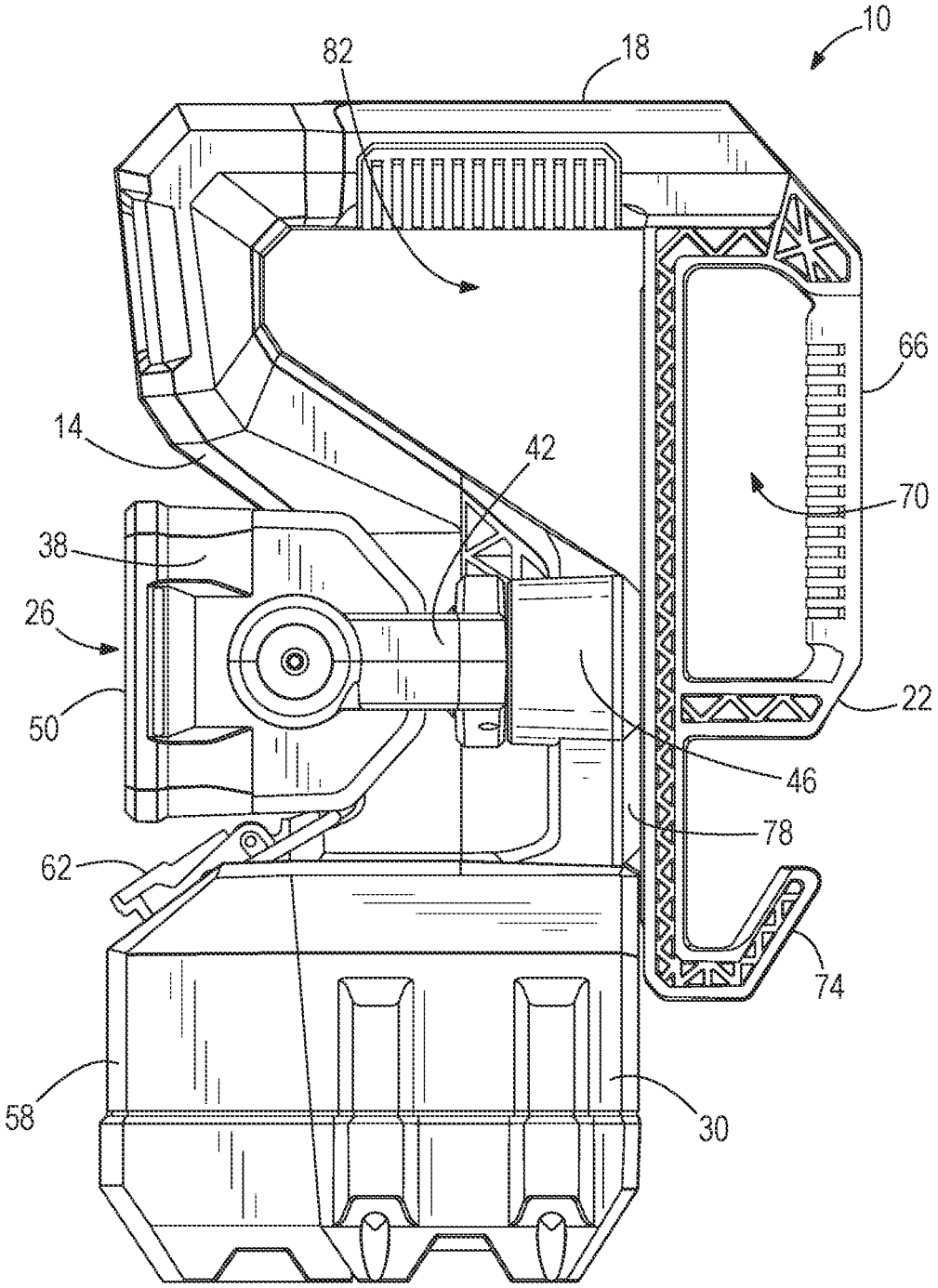
FIG. 4 is a side view of the utility mount light.
Figure 5:
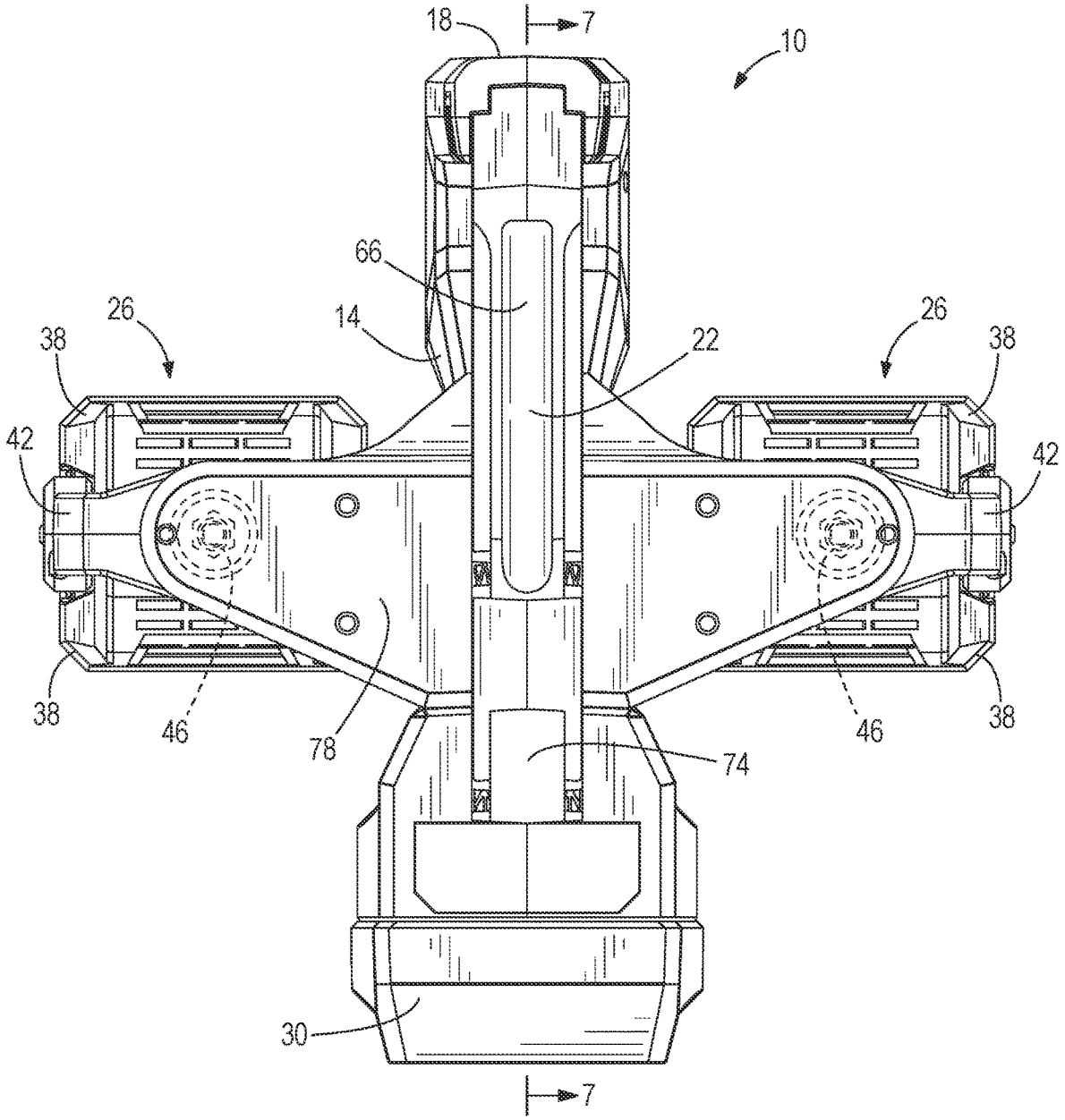
FIG. 5 is a rear view of the utility mount light.
Figure 7:
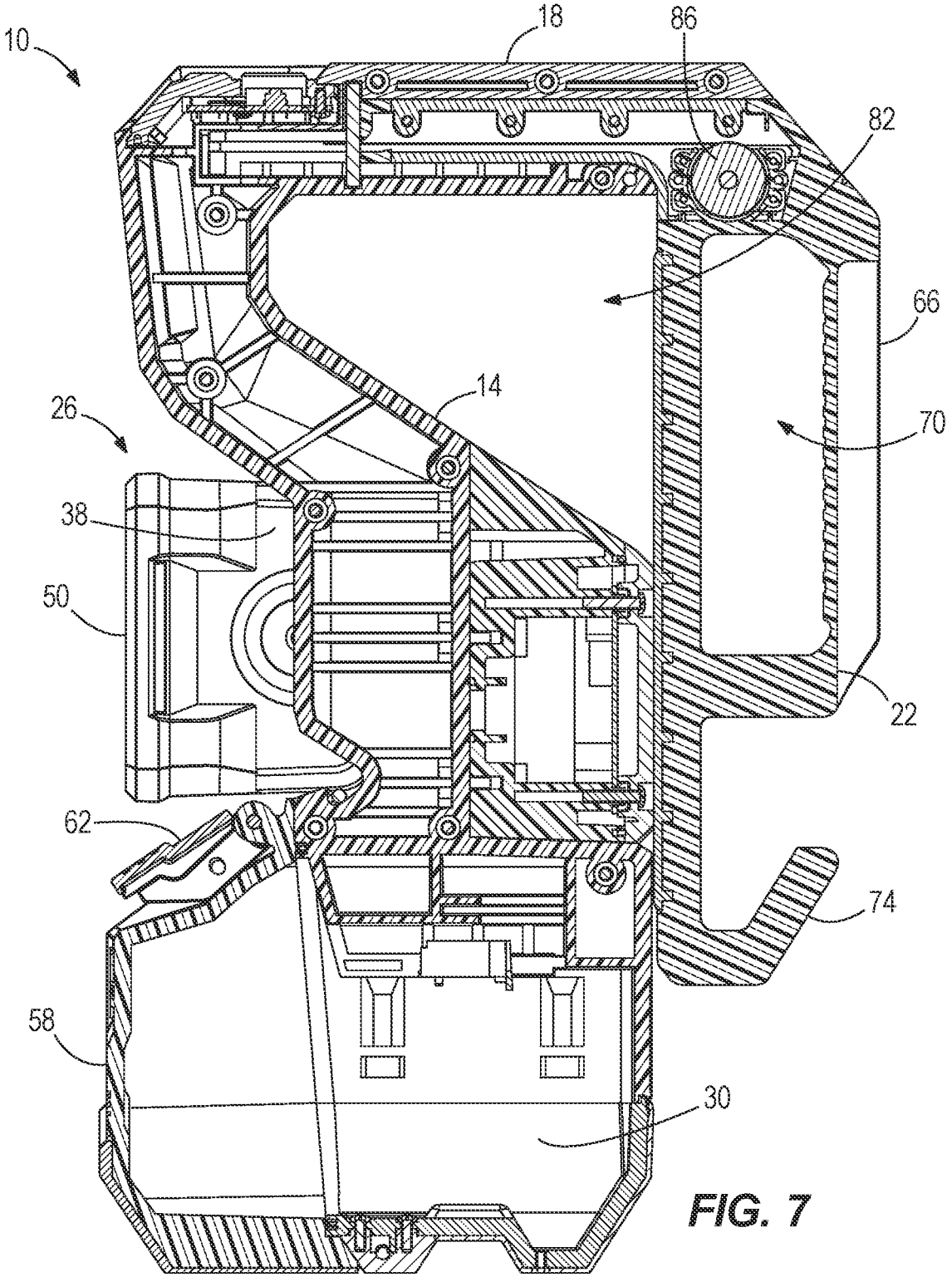
FIG. 7 is a side view of a cross section taken along line 7-7 in FIG. 3.
Figure 8:
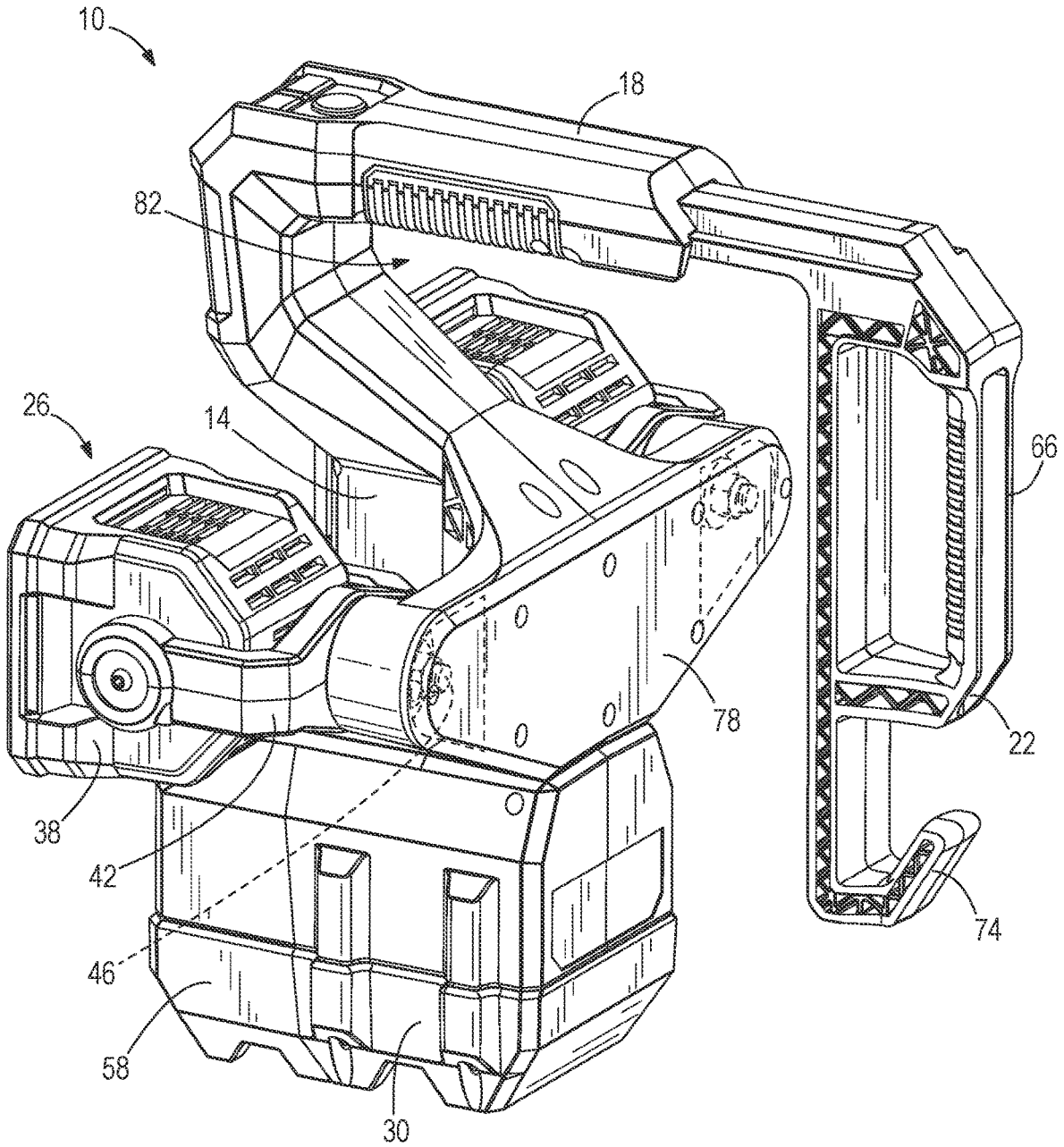
FIG. 8 is a perspective view of the utility mount light with the handle in an open or extended position.

With reference to FIGS. 2 and 4, the handle 22 includes a gripping portion 66 defined by an aperture 70 extending through the handle 22, and a hook portion 74 adjacent the gripping portion 66. The handle 22 is movably coupled to the handle portion 18 at an end adjacent the gripping portion 66, and is biased by a constant force or a clock spring 86 (FIG. 7) toward a closed position (FIG. 4) where the handle 22 maintains contact with a workpiece and/or an opposing support surface 78 disposed on the main housing 14. However, in other embodiments, other biasing members such as a torsion spring, a helical spring, or an adjustable spiral spring, among others, may be used in place of or in conjunction with the constant force spring 86. The handle 22 is movable in a linear direction to an open or extended position (FIG. 8) away from the support surface 78 (i.e., the handle 22 is linearly extensible). In addition, when the handle 22 is extended away from the support surface 78, an opening 82 is defined between the handle portion 18, the handle 22, and the main housing 14. The opening 82 is configured to receive a portion or a lip of the work platform (i.e., boom lift, man lift, basket crane, hydraladder, cherry picker, etc.) or the workpiece. In addition, the size of the opening 82 is such that it can receive a variety of differently sized lips.

In operation, the utility mount light 10 may be attached to a work platform or a workpiece using the handle 22. A user may grasp the gripping portion 66 and the main housing 14, for example, and pull the handle 22 against the bias of the constant force spring 86 toward the open position to disengage contact between the handle 22 and the support surface 78 to create a gap. The handle 22 and support surface 78 may then be placed on opposing sides of a workpiece or a work platform (i.e., a bucket, etc.) and subsequently released such that the bias of the constant force spring 86 pulls the handle 22 toward the support surface 78 to clamp the work platform or workpiece between the handle 22 and the support surface 78. In one embodiment, the movable range of the handle 22 may be limited such that the maximum gap is approximately 3.5 inches.

The utility mount light 10 may be detached from a work platform or workpiece by pulling the handle 22 against the bias of the constant force spring 86 to open a gap between the work platform or workpiece and the handle 22 and/or the support surface 78 (i.e., un-clamp the utility mount light 10 form the work platform or workpiece). However, pulling the handle 22 may not be required in some embodiments. For example, the biasing force of the constant force spring 86 may be set such that the spring 86 retracts the handle and provides the desired clamping/frictional force on the work platform or workpiece, but allows the user to detach the utility mount light 10 from the work platform or workpiece by grasping the handle portion 18 and lifting the utility mount light 10 away from the workpiece. Using this method, a user can remove the light 10 with one hand by simply grasping the handle portion 18 and pulling the light upward.

It should be noted that the placement of the gripping portion 66 of the handle 22 adjacent to the handle portion 18 provides certain advantages. This placement reduces the distance between a gripping portion 66 and the spring, thereby reducing rotational torqueing on the handle 22 and the spring during operation thereby increasing the operational life.

In addition, the linearly displaceable handle 22 advantageously allows the utility light 10 to be coupled to work platforms or workpieces of various sizes (e.g., various widths).

Various features of the invention are set forth in the following claims.

What is claimed is:

1. A utility light comprising:

a main body having a first end, a second end opposite the first end, and a length extending between the first end and the second end;

a light assembly coupled to the main body, the light assembly including a light housing and a light source supported by the light housing, the light housing being pivotable and rotatable relative to the main body;

a battery support portion configured to selectively receive a battery, the battery support portion disposed at the first end of the main body; and a clamp assembly coupled to the second end of the main body, the clamp assembly having a first member configured to be grasped for carrying and maneuvering the utility light and a second member that is linearly moveable relative to the first member;

wherein the light assembly is disposed above the battery support portion and below the second end of the main body with respect to a direction along the length of the main body, and wherein the second member of the clamp assembly is movable between a retracted position, in which the second member is adjacent the main body, and an extended position, in which a gap is defined between the second member and the main body.

2. The utility light of claim 1, wherein the second member is movable relative to the first member in a direction perpendicular to the length of the main body.

3. The utility light of claim 2, wherein the second member is biased by a spring to move relative to the first member.

4. The utility light of claim 3, wherein the spring biases the second member toward the retracted position.

5. The utility light of claim 1, wherein, when the second member is in the extended position, the gap has a dimension of approximately 3.5 inches.

6. The utility light of claim 1, wherein the light source is a first light source, and further comprising a second light source.

7. The utility light of claim 6, wherein the light housing is rotatable relative to the main body independently of the second light source.

8. A utility light comprising:

a main body having a first end, a second end opposite the first end, and a length extending between the first end and the second end;

a light assembly coupled to the main body, the light assembly including a light housing, a spot LED supported by the light housing, and a flood LED supported by the light housing, the light housing being pivotable and rotatable relative the main body;

a battery support portion configured to selectively receive a battery, the battery support portion disposed at the first end of the main body; and a clamp assembly coupled to the second end of the main body, the clamp assembly including a handle;

wherein the light assembly is disposed above the battery support portion and below the second end of the main body with respect to a direction along the length of the main body, and wherein the light assembly is operable in a plurality of modes including a spot mode in which the spot LED is activated, a flood mode in which the flood LED is activated, and a spot/flood mode in which both the spot LED and the flood LED are activated.

9. The utility light of claim 8, wherein the flood LED is one of a plurality of flood LEDs.

10. The utility light of claim 9, wherein the spot LED is one of a plurality of spot LEDs.

11. The utility light of claim 8, wherein the clamp assembly is movable between a first position, in which the utility light is attachable to and removable from a bucket of a work platform, and a second position, in which the clamp assembly is configured to secure the utility light to the bucket of the work platform.

12. The utility light of claim 11, wherein, in the first position, the clamp assembly and the main body define an opening having a horizontally-shaped recess that extends generally perpendicular to the length of the main body and a vertically-shaped recess that extends generally parallel to the length of the main body.

13. The utility light of claim 12, wherein, in the second position, the clamp assembly and the main body only define the horizontally-shaped recess.

14. The utility light of claim 11, wherein the clamp assembly is biased to move by a spring.

15. A utility light comprising configured to be attached to a bucket of an elevated work platform, the utility light comprising:

a main body having a first end, a second end opposite the first end, and a length extending between the first end and the second end;

a light assembly coupled to the main body, the light assembly including a light housing and a plurality of LEDs supported by the light housing, the light housing being pivotable and rotatable relative to the main body;

a battery support portion configured to selectively receive a battery, the battery support portion disposed at the first end of the main body; and a clamp assembly coupled to the second end of the main body, the clamp assembly having a first member that is oriented perpendicular to the length of the main body and a second member that is oriented parallel to the length of the main body, the second member being linearly movable relative to the first member in a direction that is perpendicular to the length of the main body, wherein the second member is movable relative to the main body between a retracted position, in which the clamp assembly is configured to clamp a portion of the bucket between the main body and the second member, and an extended position, in which the utility light is removable from the bucket.

16. The utility light of claim 15, wherein the battery support portion includes a cavity configured to receive the battery and a door to selectively cover the cavity.

17. The utility light of claim 16, wherein the battery support portion also includes a latch to releasably secure the door in a closed position.

18. The utility light of claim 17, wherein the battery support portion further includes a sealing member that engages the door when in the closed position.

19. The utility light of claim 15, wherein, in the extended position, the second member is spaced apart from the main body by a gap that is approximately 3.5 inches.

20. The utility light of claim 15, wherein the plurality of LEDs includes a spot LED and a flood LED.

* * * * *